United States Patent [19]

Smith et al.

[11] Patent Number: 4,550,850

[45] Date of Patent: Nov. 5, 1985

[54] CANISTER ROLL SEAM

[75] Inventors: Dwight D. Smith; Leonard J. Cranfill, both of Connersville, Ind.

[73] Assignee: Stant Inc., Connersville, Ind.

[21] Appl. No.: 428,188

[22] Filed: Sep. 29, 1982

[51] Int. Cl.[4] ..... D06F 75/26

[52] U.S. Cl. ..... 220/253; 220/69; 220/256; 413/4; 413/5

[58] Field of Search ..... 220/20, 253, 215, 66, 220/69, 70, 256; 413/4, 5

[56] References Cited

U.S. PATENT DOCUMENTS

| | | | |
|---|---|---|---|
| 2,887,244 | 5/1959 | Betner | 220/68 |
| 3,237,802 | 3/1966 | Wagner | 220/68 X |
| 3,549,042 | 12/1970 | Stolle | 220/68 |

*Primary Examiner*—Leon Gilden

*Attorney, Agent, or Firm*—Barnes & Thornburg

[57] ABSTRACT

A method is provided for producing an end plate for a container having a continuous wall, with a novel end plate being produced thereby. The end plate includes a thickened plate which is disposed perpendicular to the continuous wall, with the thickened plate having a diameter less than the inner diameter of the cylindrical walls. A sheet having a peripheral down-turned flange is disposed above the thickened plate, with the down-turned flange having a diameter greater than the diameter of the cylindrical walls. An opening is provided in the sheet which is aligned with an opening in the thickened plate. An end portion of the continuous wall is bent outwardly to form a peripheral lip which has an outer diameter less than the diameter of the sheet. A seam between the continuous wall and the metal sheet is formed by inserting a stud into the opening and engaging a groove-containing roller to the down-turned flange and peripheral lip. The stud is utilized to facilitate the rotation of the canister and seam with respect to each other to form a perimetral seam having no portion which extends above the plane of the sheet.

8 Claims, 5 Drawing Figures

CANISTER ROLL SEAM

This invention relates to canisters, and more particularly to a method of joining an end plate, or lid, to a metal canister, and the combination formed thereby.

Conventionally, thin sheet covers were joined to cylindrically walled containers by forming a rolled end seam between the wall and the cover which resulted in the formation of a circumferential rim parallel to the cylindrical wall and raised above the plane of the cover. The end plate formed by the applicant's invention provides cover for a container which obviates the need for a raised rim.

By permitting a planar cover to be formed, the invention facilitates the placement of the cover flush to a surface. In applications such as oil filters and fuel-water separators, to which this invention is particularly well-suited, the cover can be provided with a threaded opening to receive a threaded tube. An example of such a threaded tube is the threaded tube which anchors a spin-on oil filter to an automobile engine.

In accordance with the present invention, in a container having a generally continuous wall of a fixed perimeter and at least one open end, an end plate for the open end is provided which includes a cover portion and a stiffening means. The cover portion has a perimeter greater than the perimeter of the container, and at least one opening. The openings in the thickened portion and the cover portion are in alignment. A peripheral lip is disposed outwardly on the continuous wall of the container. The peripheral lip has an outer perimeter less than the perimeter of the cover portion. A seam couples the peripheral lip to the cover portion.

In a preferred embodiment, a first opening is disposed substantially at the center of the thickened portion and cover portion, and a second opening is provided which is offset from the center of the thickened portion and cover portion.

Also in accordance with the instant invention, an end plate for a container having a continuous wall is joined to the continuous wall by the following steps. An end plate is formed having a perimetral down-turned flange, with the down-turned flange having a perimeter greater than the perimeter of the continuous wall. The plate includes an opening at least partially disposed through the plate. A portion of the plate has a perimeter less than the perimeter of the continuous wall. A peripheral, outwardly projecting lip is formed on the continuous wall, with the peripheral lip having a perimeter less than the perimeter of the down-turned flange. The end plate is placed into engagement with the peripheral lip and a stud is inserted into the opening. A grooved roller is placed into engagement with the down-turned flange, and the container and grooved roller are rotated with respect to each other to form a seam between the end plate and peripheral lip.

One feature of the instant invention is that a stiffening means such as a stiffening plate is permanently added internally to the canister, and is maintained flush to the top of the canister. This feature has the advantage of eliminating the need for inserting a mandrel inside the canister and using the mandrel to rotate the canister. The stiffening plate is preferably constructed to be strong enough to withstand the torsional forces caused by inserting a stud into the opening in the end plate, and utilizing the stud to cause the canister to be rotated with respect to the roller.

The use of a stiffening plate is especially advantageous in canister applications such as oil filters, fuel-water separators, and gas filters wherein the stiffened plate can be used to prevent the canister from rupturing upon impact or wherein a filtering or separating media is mounted in the canister. Further, the holes formed in the stiffening plate are useful for inserting tubes into the canister to provide an inflow and outflow means for whatever fluid is circulated through the canister. An example of such tubes are the entry and exit tubes which are utilized in a fuel-water separator which is the subject of Application Ser. No. 241,076, filed March 6, 1981, which bears common assignee with this application.

In a preferred embodiment, the holes formed in the stiffening plate can be threaded to be received on a mating, threaded tube such as the threaded tube commonly employed to secure spin-on oil filters to an automobile engine.

Another advantage of the use of the stiffening plate is that the instant invention is adaptable for use when sealing either the first or second covers onto the canister. Mandrels can only be used when sealing the first cover to the canister.

Another feature of the instant invention is that the cover which results from the applicants' process is substantially planar at the top, with the seam being disposed alongside of the cylindrical wall, rather than above the cylindrical wall. This feature has the advantage of producing a canister with a substantially planar lid which serves as a space-saving feature. This feature is especially advantageous in situations where space is at a premium.

Additional features and advantages of the invention will become apparent to those skilled in the art upon consideration of the following detailed description of a preferred embodiment exemplifying the best mode of carrying out the invention as presently perceived. The detailed description particularly refers to the accompanying figures in which.

Figure 1:
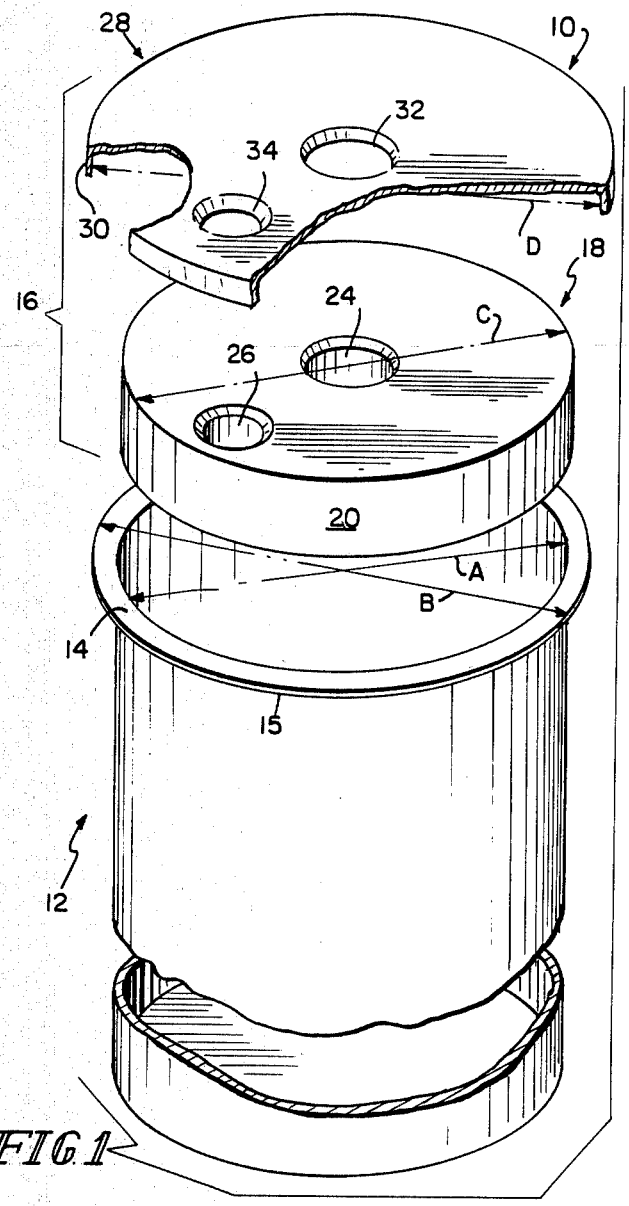
FIG. 1 is an exploded, perspective view of the invention.

Referring now to FIG. 1, a canister 10 is shown having a continuous cylindrical wall 12, with a peripheral circumferential lip 14 disposed along one edge of wall 12. Preferably, the canister 10 is constructed of metal, and has a diameter A which extends from a point on the inside of the cylindrical wall 12 to a point on the opposite side of the cylindrical wall 12. Circumferential lip 14 is preferably disposed substantially perpendicular to wall 12, and has a diameter B which is measured from a point on the outer edge 15 of circumferential lip 14 to a point on the opposite side of outer edge 15 of circumferential lip 14. End plate 16 includes a stiffening means such as thickened stiffening plate 18 having a diameter C which is measured from a pair of opposing points on surface 20 of stiffening plate 18, and is slightly less than at the inside diameter A of the cylindrical wall 12. In a cylindrical container, the thickened plate 18 is preferably disk-shaped. In a preferred embodiment, stiffening plate 18 is made of either a metal such as aluminum or a plastic which is strong enough to withstand torsional forces which will be described below. The stiffening plate 18 should be thickened to have a thickness greater than the vertical extent of the finished seam.

Disposed at least partially through stiffening plate 18 is central orifice 24 which is placed at the center of stiffening plate 18, coaxial to axis F, the axis of the canister 10. As shown in FIG. 1, central orifice 24 is substantially cylindrical in shape. Central orifice 24, however, can have a different shape, depending upon the use to which the canister is put. Stiffening plate 18 also includes offset orifice 26 which, in the preferred embodiment, is also cylindrical in shape.

Cover 28 includes around its outer periphery a down-turned flange 30 which has a diameter D which is measured from a point on the inner surface 31 of down-turned flange 30 to a point on the inner surface 31 of down-turned flange 30 opposite the first point. Diameter D of the down-turned flange 30 is slightly greater than the diameter B of the circumferential lip 14. Cover 28 also includes a central aperture 32 which is positionally aligned with central orifice 24, and is approximately of the same size and shape. Offset aperture 34 is aligned with offset orifice 26, and is also preferably of the same shape and size as offset orifice 26.

The holes formed in the stiffening plate can be threaded to be received on a mating, threaded tube such as the threaded tube commonly employed to secure spin-on oil filters to an automobile engine.

The size relationships discussed above between the stiffening plate 18, continuous cylindrical wall 12, peripheral circumferential lip 14, and down-turned flange 30 have been discussed in terms of relative diameters. The relative sizes could also have been furnished in terms of relative perimeters, as the perimeter of a circular object is directly related to the diameter of that object. In a container with a non-cylindrical continuous wall, the outer perimeter of the thickened stiffening plate would be less than the inner perimeter of the continuous wall, and the outwardly disposed peripheral lip would have a perimeter less than the perimeter of the down-turned flange.

Figure 2:
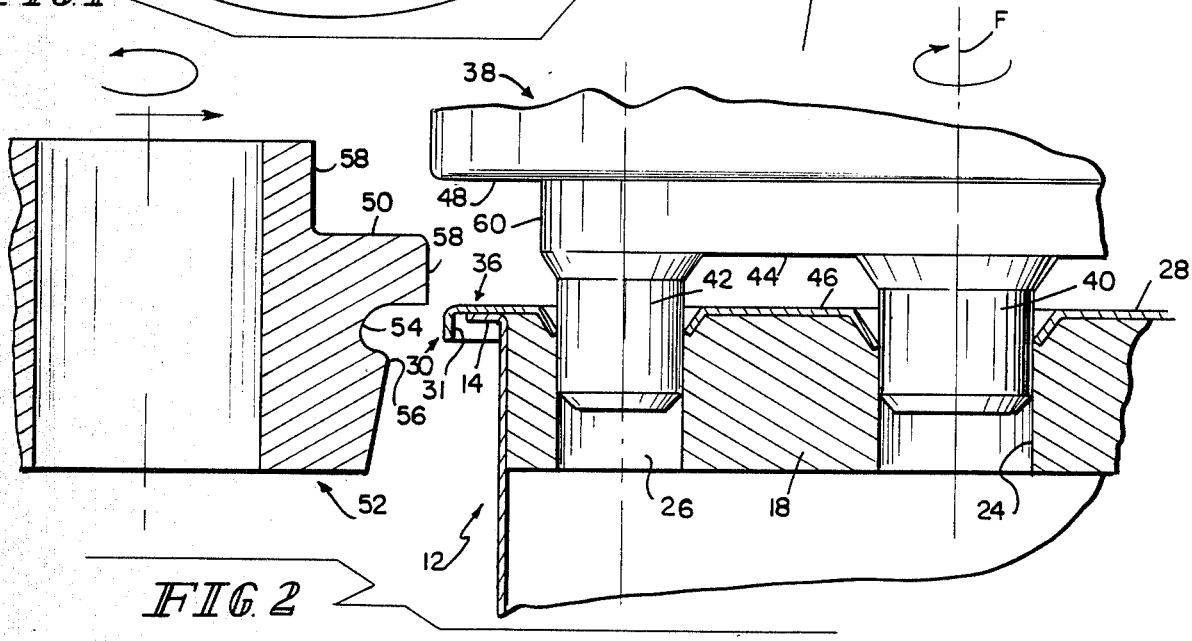
FIG. 2 is a partial, cross-sectional view of the invention illustrating the invention as it would appear before the rolling operation.

Referring now to FIG. 2, a partial, cross-sectional view of the end plate is shown as it would appear before a rolling operation. The stiffening plate 18 is placed inside cylindrical wall 12 adjacent to and in contact with cover 28. Edge portion 36 of cover 28 is placed above the circumferential lip 14 of the cylindrical wall, with down-turned flange 30 extending out past circumferential lip 14.

Drive fixture 38 containing central stud 40 and offset stud 42 is placed into engagement with stiffening plate 18 and cover 28. Central stud 40 is sized and positioned to be received by central orifice 24 and central aperture 32. Offset stud 42 is sized and positioned to be received by offset orifice 26 and offset aperture 34. Lower surface 44 of drive fixture 38 is positioned above upper surface 46 of the cover, and edge portion 48 of lower surface 44 is positioned to engage platform portion 50 of roller 52.

Figure 3:
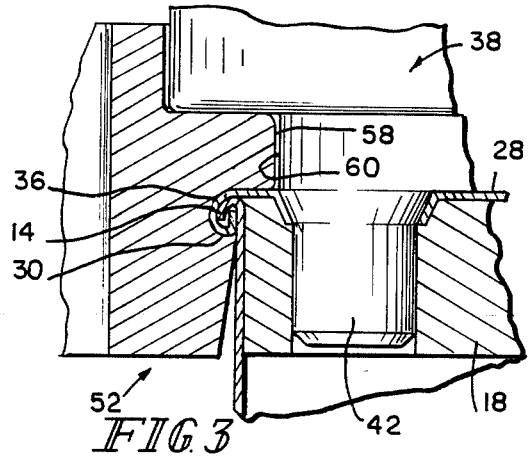
FIG. 3 is a partial, cross-sectional view of the invention as it would appear during the first rolling operation.
Figure 4:
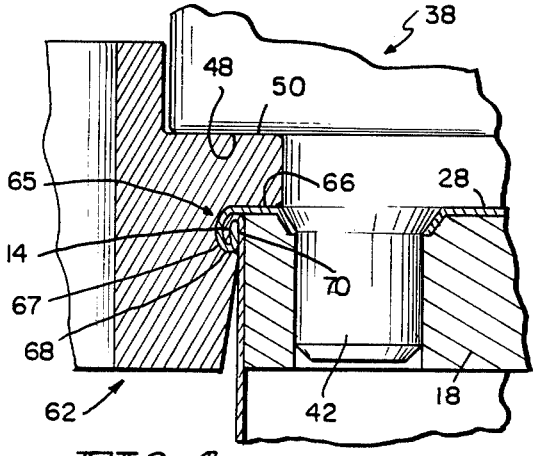
FIG. 4 is a partial, cross-sectional view of the invention as it would appear during the second rolling operation.

First operation roller 52 includes a groove 54 which is sized to receive down-turned flange 30, edge portion of cover 36, and circumferential lip 14 to bend the down-turned flange 30, edge portion 36, and circumferential lip 14 into engagement with each other. Roller 52 further includes a protuberant surface 56 which is positioned to engage a portion of the cylindrical wall 12. Vertical surfaces 58 of first operation roller 52 are sized and positioned to engage the vertical surfaces 60 on the drive fixture 38. As shown in FIGS. 3 and 4, the engagement of lower surface 44 of drive fixture 38 with upper surface 46 of cover 28, and engagement of lower surface 48 of drive fixture 38 with upper surface 50 of first operation roller 52 serves to place the drive fixture 38, roller 52, and end plate 16 in a proper vertical relation to each other and maintains the vertical relation of the above-mentioned three components during the rolling operation.

The placement of central stud 40 into central aperture 32 and central orifice 24, the placement of offset stud 42 into offset aperture 34 and offset orifice 26, the enagement of protuberance 56 with cylindrical wall 12, and engagement of vertical surfaces 58 of roller 52 with vertical surfaces 60 of drive fixture 38 serves to place the roller 52, end plate 16, and drive fixture 38 in a proper lateral relation during the rolling operation. The placement also serves to maintain the above-mentioned three components in a proper lateral relation during the rolling operation. Further, the insertion of studs 40, 42 in apertures 32, 34 and orifices 24, 26 serves to provide a means for holding the end plate 16 in position when the roller 52 is exerting lateral pressure against the canister 10.

Figure 5:
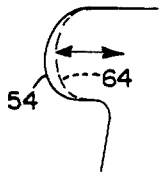
FIG. 5 is an enlarged, diagrammatic view of the rollers of the first and second operation, illustrating the differences therebetween.

Referring now to FIG. 4, a second operation roller 62 is shown. Although similar to first operation roller 52, second operation roller 62 has groove 64 which is different in size and shape than groove 54 of first operation roller 52. Referring now to FIG. 5, groove 54 of first operation roller 52 is shown in solid lines and groove 64 of second operation roller 62 is shown in dotted lines to illustrate the relative size differences between the two grooves 54, 64. The depth E of groove 64 of second operation roller 62 is less than the depth of groove 54 of first operation roller 52. The smaller groove 64 of second operation roller 62 places the down-turned flange 30 and edge portion 36 of cover 28 into closer engagement with the circumferential lip 14 and wall 12 of can 10 to permit a tighter seam to be rolled.

In operation, the following method is employed to manufacture the rolled seam. Cylindrical walls 12 and circumferential lip 14 are formed by a conventional process. Stiffening plate 18 is formed having central orifice 24 and offset orifice 26. Cover 28 is formed with down-turned flange 30, central aperture 32, and offset aperture 34. Stiffening plate 18 is placed adjacent cover 28 and cover 28 is placed upon circumferential lip 14. When so placed, the stiffening plate 18 is disposed inside the cylindrical wall 12 of can 10.

Referring now to FIGS. 2–5, drive fixture 38 is placed above can 10. Central stud 40 is aligned with central orifice 24 and central aperture 32. Offset stud 42 is placed in alignment with offset orifice 26 and offset aperture 34. Central stud 40 and offset stud 42 are simultaneously inserted into their respective orifices 24, 26 and apertures 32, 34. Roller 52 is moved laterally into engagement with down-turned flange 30, edge portion 36, circumferential lip 14, and drive fixture 38. The lateral engagement of the roller 52 to the canister 10 and drive fixture 38 causes the groove 54 of the first operation roller 52 to bend the edge portion 36 of cover 28 downwardly, around the outside of downwardly bent circumferential lip 14 and to bend down-turned flange 30 upwardly, positioning it between the downwardly bent circumferential lip 14 and the wall 12 of the canister 10. The drive fixture 38 and roller 52 are then rotated with respect to each other to cause the bending of the edge portion 36, down-turned flange 30, and circumferential lip around the entire perimeter of the canister.

The stiffening plate 18 is preferably thicker than the vertical extent of the seam 65. The placement of the stiffening plate 18 inside the cylindrical wall 14 adjacent the seam 65 prevents the cylindrical wall 14 from either becoming deformed or moving radially inwardly during the rolling operations by providing a means for reinforcing the cylindrical wall 14.

After the first operation roller has completed its bending on part or all of the cover portion 28 and cylindrical wall 12, second operation roller 62 is placed into engagement with canister 10 and drive means 38. The groove 64 of second operation roller 62, being smaller than groove 54 of first operation roller 52, places the cover 28 and cylindrical wall 12 into closer engagement than does first operation roller 52 and groove 54.

After the second operation roller 62 has completed its sealing operation, the down-turned flange 30 and edge portion 36 are sealably engaged to the peripheral lip 14. When so sealed, the down turned flange 30 and edge portion 36 include a first portion 67 which is disposed substantially parallel to and around the outer surface of lip 14, a second portion 68 which is disposed equidiametrically with the peripheral lip and a third portion 70 which is disposed vertically upwardly between the peripheral lip 14 and the cylindrical wall 12. It will also be noticed that the top edge surface 66 of cover 28 is substantially flat, and contains no raised bead, such as the raised bead commonly found on cans containing food, beverages, and the like.

As drive fixture 38 and rollers 52, 62 are rotated with respect to each other, it can be appreciated that significant torsional forces will be exerted on the side walls of orifices 24, 26 and apertures 32, 34. If rollers 52, 62 are rotated around drive fixture 38, the engagement of studs 40, 42 into orifices 24, 26 and apertures 32, 34 serves to hold the canister 10 stationary and prevents canister 10 from rotating in response to the rotational forces exerted by the rollers 52, 62. If drive fixture 38 is rotated about the axis F of canister 10 while the rollers 52, 62 maintain a fixed position, the studs 40, 42 will exert a torsional force on the side walls of orifices 24, 26 and apertures 32, 34 to cause the canister to rotate.

Although the invention has been described in detail with reference to certain preferred embodiments, variations and modifications exist within the scope and spirit of the invention as described and as defined in the following claims.

What is claimed is:

1. In a metal container having a generally continuous wall of fixed perimeter and at least one open end, an end plate for the open end comprising a stiffening means having sufficient strength to withstand a radially inwardly directed force exerted by a roller against the continuous wall during a seam-forming operation, the stiffening means having a perimetrical surface disposed conformably adjacent to and interiorly of the generally continuous wall, a cover portion disposed exteriorly of the stiffening means, the cover portion having a perimeter greater than the perimeter of the container, at least one opening in the cover portion, an outwardly disposed peripheral lip on the continuous wall, the peripheral lip having an outer perimeter less than the perimeter of the cover portion, and a rolled seam for coupling the peripheral lip to the cover portion.

2. The invention of claim 1 wherein the stiffening means comprises a thickened portion having a perimeter less than the perimeter of the container, the thickened portion having an opening aligned with the opening in the cover portion.

3. The invention of claim 2 wherein the thickened portion comprises a plate which is thicker than the vertical extent of the seam, and the thickened portion being disposed flush to the cover portion.

4. The invention of claim 1 wherein the at least one opening comprises a first opening disposed substantially at the center of the cover portion and second openings offset from the center of the cover portion.

5. The invention of claim 1 wherein the cover portion further comprises a down-turned flange portion and the down-turned flange portion includes a first portion disposed substantially parallel to and around an outer surface of the peripheral lip, a second portion disposed equidiametrically with the peripheral lip, and a third portion disposed between the peripheral lip and the continuous wall.

6. In a container having a generally continuous wall of fixed diameter and at least one open end, the improvement comprising an end plate which comprises a disk-shaped stiffening plate having a diameter less than the diameter of the continuous wall and a perimetrical surface disposed conformably adjacent to and interiorly of the generally continuous wall, the perimetrical surface having an axial height, a sheet disposed contigusously to and exteriorly of the disk-shaped stiffening plate, the sheet having a diameter greater than the diameter of the continuous wall, an opening in the sheet and an opening in the disk-shaped plate, the openings being aligned, a peripheral outwardly bent lip of the continuous wall, the lip having an outer diameter less than the diameter of the sheet, and a rolled seam for coupling the peripheral lip to the sheet, the rolled seam being disposed radially outwardly of and at the same general axial position as the disk-shaped stiffening plate, the seam having an axial height less than the axial height of the disk-shaped stiffening plate.

7. A canister comprising a cylindrical wall, a cover for covering an end of the canister and a disk-shaped stiffening plate disposed interiorly of and contiguously to the cover and the cylindrical wall, said cylindrical wall having a radially outwardly disposed peripheral lip and said cover having an axially projecting peripheral flange formed to engage said lip to provide a peripheral rolled seam joint extending axially from said cover and radially outwardly from said cylindrical wall, the peripheral rolled seam joint and cover forming a generally planar end surface of the canister.

8. The invention of claim 7 wherein the cover and disk-shaped stiffening plate include aligned openings to provide communication between the outside and inside of the container.

* * * * *